US006034637A

United States Patent [19]

McCoy et al.

[11] Patent Number: 6,034,637

[45] Date of Patent: *Mar. 7, 2000

[54] DOUBLE RESONANT WIDEBAND PATCH ANTENNA AND METHOD OF FORMING SAME

[75] Inventors: Danny O. McCoy; Quirino Balzano, both of Plantation, Fla.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/996,899

[22] Filed: Dec. 23, 1997

[51] Int. Cl.[7] ..... H01Q 1/38

[52] U.S. Cl. ..... 343/700 MS; 343/846

[58] Field of Search ..... 343/700 MS, 846, 343/848, 847; H01Q 1/38

[56] References Cited

U.S. PATENT DOCUMENTS 5,111,211 5/1992 Dahlberg ..... 343/700 MS

*Primary Examiner*—Hoanganh Le
*Attorney, Agent, or Firm*—Frank M. Scutch, III

[57] ABSTRACT

A double resonant wideband patch antenna (100) includes a planar resonator (101) forms a substantially trapezoidal shape having a non-parallel edge (103) for providing a substantially wide bandwidth. A feed line (107) extends parallel to the non-parallel edge (103) for coupling while a ground plane (111) extends beneath the planar resonator for increasing radiation efficiency.

7 Claims, 2 Drawing Sheets

DOUBLE RESONANT WIDEBAND PATCH ANTENNA AND METHOD OF FORMING SAME

TECHNICAL FIELD

This invention relates in general to antennas and more particularly to two-way radio patch-type antennas.

BACKGROUND

Patch-type antennas are well known for use in high frequency radio frequency (RF) applications as offering acceptable losses as compared with an isotropic antennas. Moreover, a patch offers the advantage of occupying only a limited surface area. Patch type antennas typically are dimensionally flat and include a radiator that is positioned upon a section of substrate material. The patch antenna is generally unidirectional and radiates in a plane at a right angles to the surface of the radiator. Thus, depending on the orientation of the antenna, RF radiation can be directed away from a user of a portable communications device.

One problem associated with the patch antenna is its narrow bandwidth. Typically this type of antenna will have a bandwidth of approximate 100 MHz at resonant frequency of 1.5 GHz with a voltage standing wave ratio (VSWR) of 2:1 or less. Practically speaking at such high frequencies this limits its application to situations where large changes in frequency are not encountered. Thus the need exists to provide a patch antenna that provides the advantages of low loss and directivity in a flat package that will function over a wide frequency range.

DETAILED DESCRIPTION OF THE PREFERRED EMBODIMENT

Figure 1:
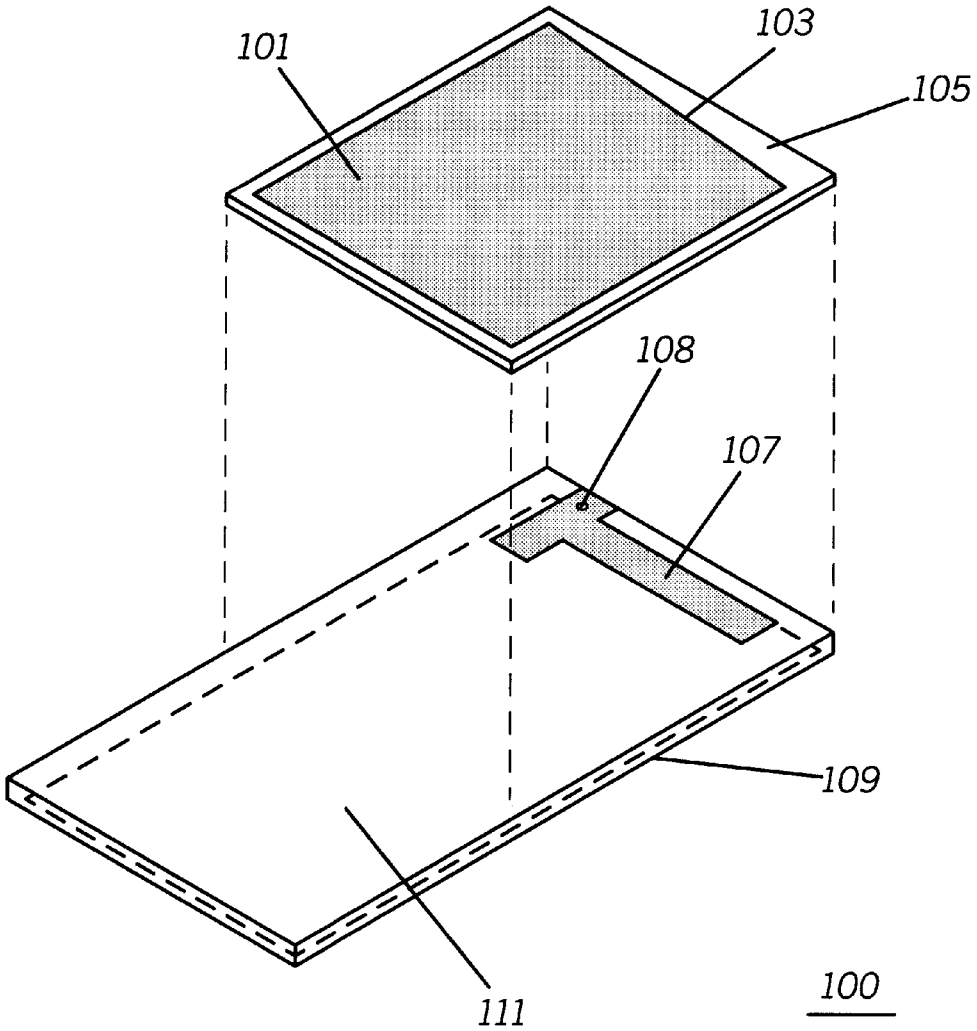
FIG. 1 is an exploded isometric view of the double resonant cross-fed wideband patch antenna according to the preferred embodiment of the invention.

Referring now to FIG. 1, the double resonant wide band patch antenna 100 includes a planar resonator 101 formed into a trapezoidal shape. The planar resonator 101 is positioned on a substrate 105 and includes a non-parallel edge of 103. The non-parallel edge of 103 is offset at an angle of approximately ten degrees from the adjacent non-parallel side of the trapezoid. The planar resonator 101 is formed of a highly conductive material such as copper or the like and acts to radiate radio frequency (RF) energy in a unidirectional pattern. As is known in the art, the substrate 105 is typically manufactured out of a fire retarding epoxy resin/glass laminant (FR-4) but other compounds such as bismaleimide/triazine (BT) or polyimide may also be used.

Positioned below the planar resonator 101, a feedline 107 is used to couple RF energy to the planar resonator 101. The feedline 107 typically is fed from one edge of the feedline by a feed point 108. The feedline 107 has a predetermined length and uniform width across the substrate 105. The feedline 107 forms an substantially "L" shape and is positioned in parallel with the non-parallel edge 103 of the planar resonator 101. The feedline 107 allows the planar resonator 101 to be resonant along at least two points in a given frequency spectrum.

For example, between 1.5 and 2.5 GHz the planar resonator 101 with a resonance at two points allows the resonator to be broad band with a bandwidth of approximately 300 MHz. As will be evident to this skilled in the art, this allows the double resonant wide band patch antenna 101 to be used over a wide frequency spectrum without the need to use a plurality of patch antennas over a similar frequency range. The feedline 107 is also positioned on a substrate 109. The substrate 109 may also be made from a section of FR-4 material. Positioned beneath the feedline 107 on the underside of substrate 109 a ground plane 111 is used to increase the total radiation efficiency of the double resonant wide band patch antenna 100.

Figure 2:
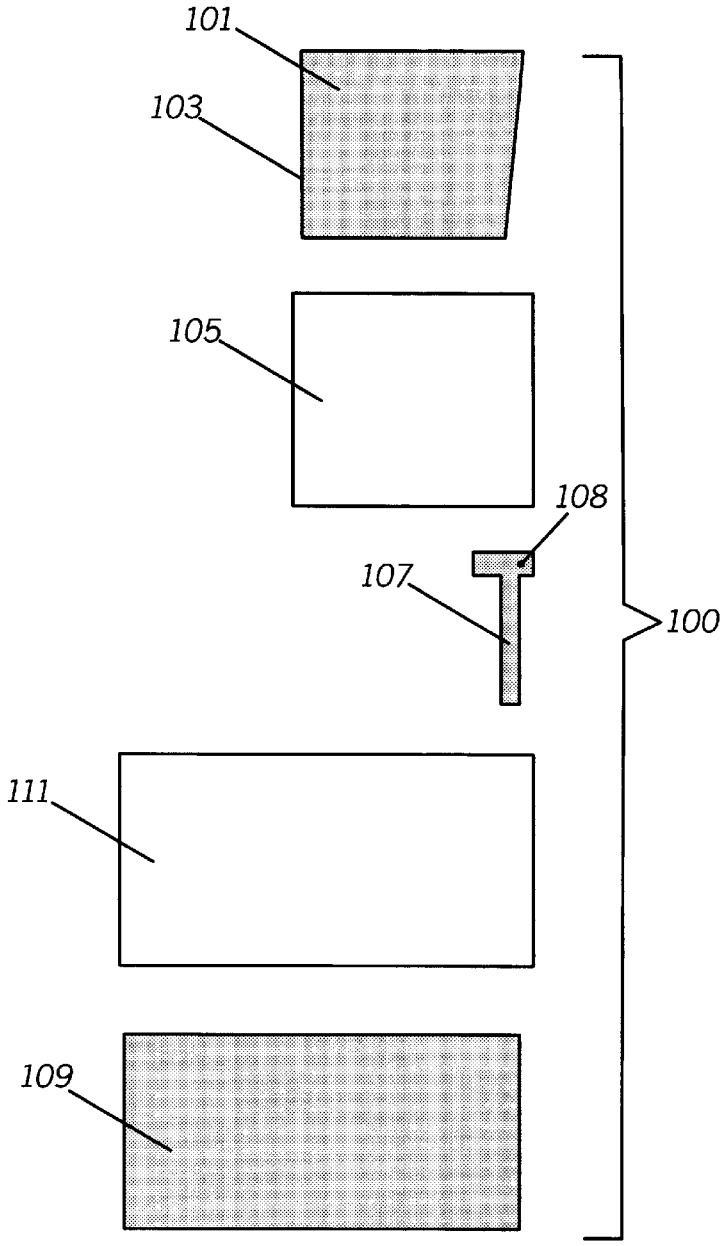
FIG. 2 is a top view of the various layered components of that shown in FIG. 1.
Figure 3:
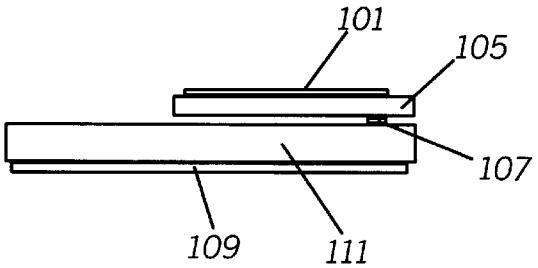
FIG. 3 is a side view of the double resonant cross-fed wideband patch antenna as seen in FIG. 1.

As seen in FIG. 2, a top view of the various layered components as seen in FIG. 1. These include the planar resonator 101, substrate 105, feedline 107, substrate 111, and ground plain 109. As seen in FIG. 3, these elements are positioned in a sandwich-like fashion producing a substantially flat planar like patch structure providing a unique directional radiation pattern.

With regard to the preferred method of providing a double resonant wide band patch antenna, these includes the steps of positioning a planar resonator having a trapezoidal shape with one non uniform edge on FR-4 substrate. A feedline is in position on a second substrate in proximity to the non uniform edge of the planar resonator. A ground plain is then positioned on the second substrate beneath the feedline for increasing the radiation efficiency of the double resonant wide band patch antenna. As seen in FIG. 1, the feedline is oriented such that it extends parallel to the non uniform edge of the planar resonator. This insures that the planar resonator will resonate at least two points, allowing the antenna to perform over a substantially wide frequency range.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A double resonant wideband patch antenna comprising:

a unitary planar resonator forming a trapezoidal shape;

a parasitically coupled substantially L-shaped feed line extending along at least one non-parallel edge of the planar resonator; and a ground plane extending beneath the planar resonator for increasing radiation efficiency.

2. A double resonant wideband patch antenna as in claim 1 wherein the feedline is positioned in parallel with the one non-parallel edge.

3. A wideband patch antenna having at least two points of resonance over a predetermined frequency range comprising:

a unitary planar trapezoidal resonator having a single non-parallel edge;

a parasitically coupled substantially L-shaped feed line positioned below the planar trapezoidal resonator for feeding the single non-parallel edge with radio frequency (RF) energy; and a ground plane positioned below the planar trapezoidal resonator and feed line for increasing radiation efficiency.

4. A wideband patch antenna as in claim 3 wherein the feed line is fed from one side and has a uniform width extending along the non-parallel edge of the planar trapezoidal resonator.

5. A method for providing a double resonant wideband patch antenna including the steps of:

positioning a unitary planar resonator having a trapezoidal shape with one non-uniform edge on a first substrate;

positioning a parasitically coupled substantially L-shaped feed line on a second substrate in proximity to the one-non uniform edge; and positioning a ground plane on a second substrate beneath the feed line for increasing radiation efficiency of the double resonant wideband patch antenna.

6. A method of providing a double resonant wideband patch antenna as in claim 5 further including the steps of:

orienting the feed line such that it extends parallel to the non-uniform edge of the first substrate.

7. A method for providing a double resonator wideband patch antenna as in claim 5, wherein the feed line has a uniform width.

* * * * *